US006554009B1

(12) United States Patent
Beijbom et al.

(10) Patent No.: US 6,554,009 B1
(45) Date of Patent: Apr. 29, 2003

(54) DEVICE AT WASHING APPARATUS FOR WASHING OBJECTS, PREFERABLY SPRAY GUNS, WITH WASHING LIQUID, PREFERABLY A SOLVENT

(75) Inventors: Peter Beijbom, Lund (SE); Niklas Johansson, Malmö (SE); Stefan Cedergren, Bunkeflostrand (SE)

(73) Assignee: Hedson Technologies AB, Arlov (SE)

( * ) Notice: Subject to any disclaimer, the term of this patent is extended or adjusted under 35 U.S.C. 154(b) by 175 days.

(21) Appl. No.: 09/722,921

(22) Filed: Nov. 27, 2000

(51) Int. Cl.[7] ..... B08B 3/02

(52) U.S. Cl. ..... 134/95.3; 134/104.2; 134/166 C; 134/171; 134/200

(58) Field of Search ..... 134/166 R, 166 C, 134/171, 200, 104.2, 95.3; 68/18 C, 18 R

(56) References Cited

U.S. PATENT DOCUMENTS

| | | | | |
|---|---|---|---|---|
| 3,583,181 | A | * | 6/1971 | Briillet |
| 3,915,808 | A | * | 10/1975 | Wilcox |
| 4,025,363 | A | * | 5/1977 | Desantis |
| 4,235,600 | A | * | 11/1980 | Capella et al. |
| 4,254,646 | A | * | 3/1981 | Selssnick |
| 4,819,677 | A | * | 4/1989 | Stern |
| 4,824,487 | A | * | 4/1989 | Heffernan |
| 4,881,561 | A | * | 11/1989 | Schwarzwalder |
| 5,318,056 | A | * | 6/1994 | Kusz et al. |
| 5,549,128 | A | * | 8/1996 | Mansur |
| 5,704,381 | A | * | 1/1998 | Millan et al. |
| 5,937,875 | A | * | 8/1999 | Nygren |
| 6,003,530 | A | * | 12/1999 | Giuseppe |

FOREIGN PATENT DOCUMENTS

| | | | |
|---|---|---|---|
| DE | 4225848 A1 | | 2/1994 |
| DE | 2000483 | * | 8/2000 |
| EP | 0443421 | | 8/1991 |
| GB | 2311475 | * | 10/1997 |
| JP | 1-227797 | * | 9/1989 |
| JP | 10-286401 | * | 10/1998 |
| WO | 9901230 | | 1/1999 |

OTHER PUBLICATIONS

European Patent Application 481,474.*

* cited by examiner

*Primary Examiner*—Frankie L. Stinson
(74) *Attorney, Agent, or Firm*—Tarolli, Sundheim, Covell & Tummino L.L.P.

(57) ABSTRACT

The present invention relates to a device at washing apparatus for washing objects, preferably spray guns, with a washing liquid, preferably a solvent. The washing apparatus (1, 2, 3 or 3A) has at least one wash chamber (5) in which the object (4) is located for washing and at least one first container (B1) for collecting impure washing liquid from the wash chamber (5). The washing apparatus (1, 2, 3 or 3A) further comprises a distilling device (8) for distillation of impure washing liquid and obtaining pure washing liquid. This distilling device (8) includes a third container (B3) in which impure washing liquid is vaporized. Means are provided to see to that the volume (V1) of impure washing liquid which at the most or as a maximum can be brought to flow from said first container (B1) to said third container (B3) is equal to or less than the volume (V3) for washing liquid in said third container (B3) in order to prevent said third container (B3) from located overfull (FIG. 1).

11 Claims, 4 Drawing Sheets

DEVICE AT WASHING APPARATUS FOR WASHING OBJECTS, PREFERABLY SPRAY GUNS, WITH WASHING LIQUID, PREFERABLY A SOLVENT

The present invention relates to a device at washing apparatus for washing objects, preferably spray guns, with washing liquid, preferably a solvent. Said washing apparatus has at least one wash chamber in which the object is located for washing. The washing apparatus further includes at least one first container for collecting impure washing liquid and at least one first conduit through which washing liquid can flow from the wash chamber to the first container as well as at least one second conduit through which impure washing liquid can be brought to flow back to the wash chamber for reuse. The washing apparatus also includes at least one second container for pure washing liquid and at least one third conduit through which pure washing liquid can be brought to flow from said second container to the wash chamber for washing the object with pure washing liquid. The washing apparatus further comprises a distilling device for distillation of impure washing liquid and obtaining pure washing liquid, said distilling device including a third container in which impure washing liquid is vaporized.

Furthermore, the washing apparatus has a fourth conduit through which impure washing liquid can flow from said first container to said third container and at least one fifth conduit or at least one sixth and seventh conduit for allowing pure washing liquid obtained by means of the distilling device to be collected in said second container.

The washing apparatus for washing spray guns with solvent for cleaning thereof from paints and lacquers, is already known from EP 0 443 421 and WO 99/01230. Certain prior art washing apparatus also include distilling devices for cleaning impure solvent. At such a washing apparatus, impure solvent is pumped to a container in the distilling device. A problem thereby is that this pumping must be supervised manually such that the content in the container does not overflow and that despite manual supervision there is a risk that solvent overflows because pumping is not stopped in time.

The object of the present invention is to eliminate this problem and this is done by providing the washing apparatus defined above substantially with the characterizing features of subsequent claim 1.

Since the invention has said characterizing features, it is achieved that pumping of impure washing liquid to the container in the distilling device does not need to be manually supervised and that the risk for overflow of the impure washing liquid is eliminated.

The invention will be further described below with reference to the accompanying drawings, in which FIG. 1 schematically illustrates a washing apparatus according to the invention;

Figure 1:
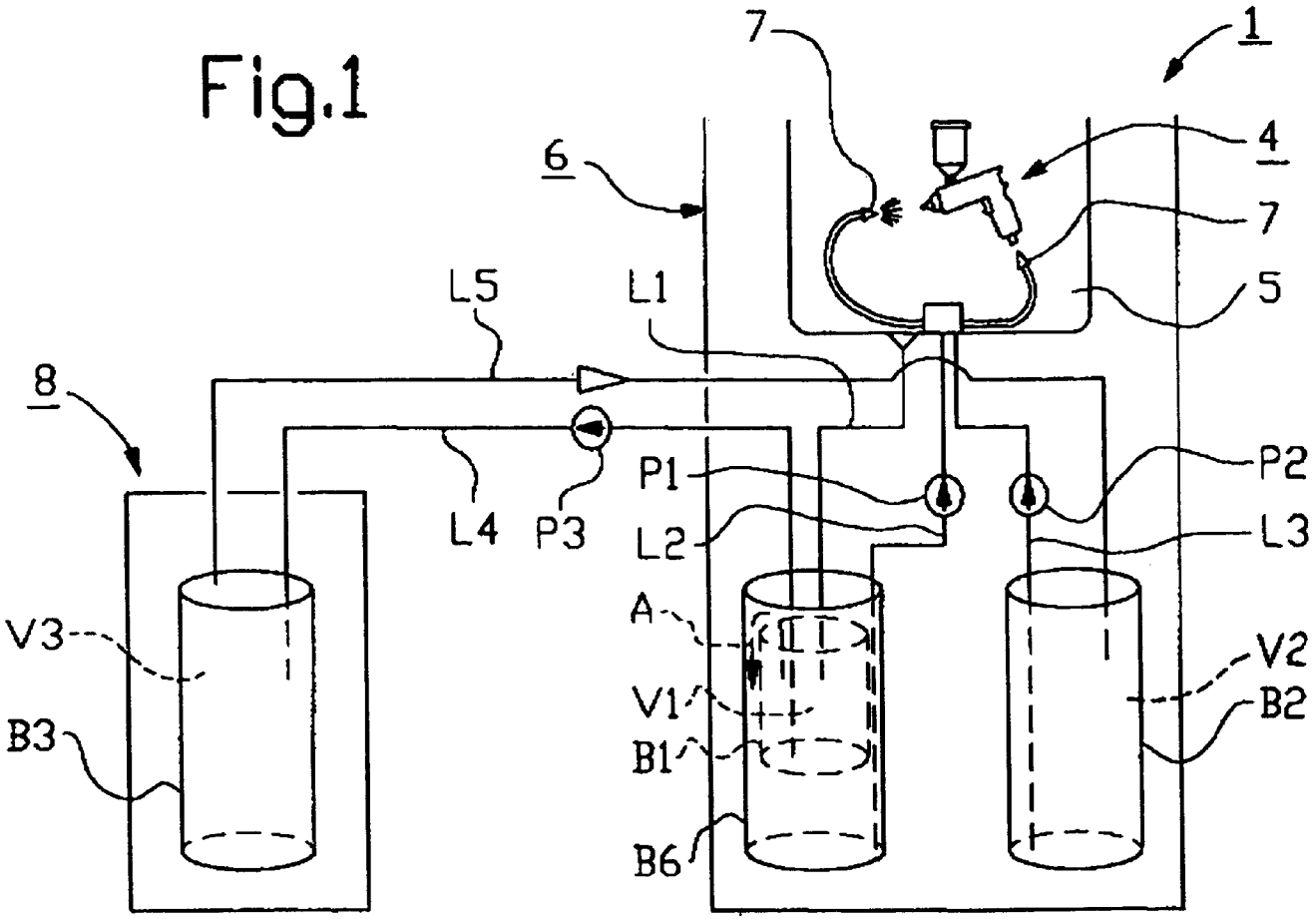

The washing apparatus 1, 2 and 3 illustrated in the drawings are adapted for washing objects, preferably spray guns 4 of e.g. the type used for painting cars, with washing liquid. These spray guns 4 and eventual associated members are located in a schematically illustrated wash chamber 5 having brackets (not shown) for the spray gun and provided in a wash cabinet 6 or any other suitable location. In the wash chamber 5 there are one or more washing-liquid nozzles 7 which are mounted such that they discharge or eject washing liquid for washing the spray gun 4 exteriorly and/or interiorly until residues of paint and/or lacquer adhering thereon and/or therein have been removed. The washing-liquid nozzles 7 are adapted to perform an automatic washing process. The washing liquid may be a suitable solvent, e.g. paint thinner, which can dissolve paint and/or lacquer residues on and in the spray gun 4.

The washing apparatus 1–3 include a number of containers B1–B6 for impure and pure solvent and a number of liquid conduits L1–L7 for feeding or guiding solvent between the containers.

Thus, the washing apparatus 1 has a first container B1 which is provided in a container B6 and there is a first conduit L1 from the wash chamber 5 to this first container B1. The first conduit L1 is provided to feed impure solvent, which after washing of the spray gun 4 is located in the wash chamber 5, from said wash chamber to the first container B1, When this first container B1 is full, impure solvent can flow over the upper or top edge thereof and down into the sixth container B6 (see arrow A).

At least one second conduit L2 is located between the sixth container B6 and the washing-liquid nozzles 7 in the wash chamber 5 and at least one first liquid pump P1 is provided to pump impure solvent from the sixth container B6 to said washing-liquid nozzles 7 and out therethrough.

The washing apparatus 1 includes a second container B2 in which pure solvent is provided, adapted for washing of the spray gun 4. At least one third conduit L3 is provided to feed pure solvent from the second container B2 to the washing-liquid nozzles 7 and at least one liquid pump P2 is provided to pump the pure solvent to and out through said nozzles 7.

A distilling device 8 is provided to boil impure solvent and through a process of distillation obtain pure solvent for use thereof during washing. Distilling devices 8 for this purpose are well known and therefore, not described in detail here.

The distilling device 8 includes a third container B3 and a fourth conduit L4 is provided to feed impure solvent from the first container B1 to the third container B 3. A third liquid pump P3 is provided to pump the impure solvent through the fourth conduit L4. A fifth conduit L5 is provided to feed pure solvent from the distilling device 8 to the second container B2 and this can be done eventually by self-flow, which is easy to carry through if the wash cabinet 6 and the distilling device 8 stand close to each other.

At the washing apparatus 1, 2 and 3, means are provided to see to that the volume V1 of impure solvent which at the most or as a maximum can be brought to flow from said first container B1 to said third container B3 is equal to or less than the volume V3 for solvent in said third container B3 in order to prevent said third container B3 from becoming overfull.

Said means can be located and designed in various ways and they preferably are provided by forming the first container B1 such that its total volume V1 for impure washing liquid is equal to or less than the volume V3 for washing liquid in the third container B3.

Figure 2:
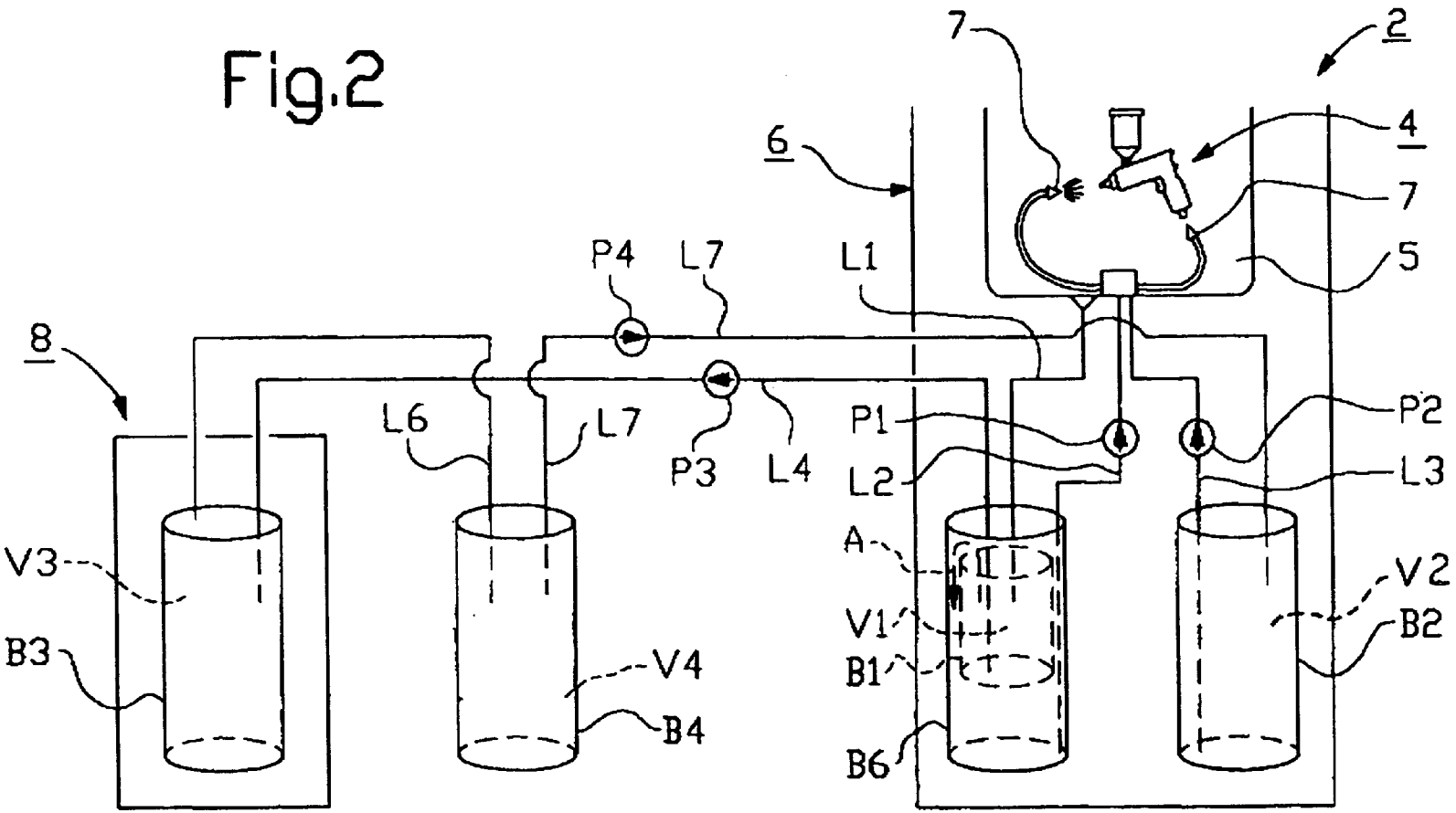
FIG. 2 illustrates a first alternative embodiment of the washing apparatus according to the invention.

The washing apparatus 2 illustrated in FIG. 2 corresponds with the washing apparatus 1 of FIG. 1 except for that there is fourth container B4, a sixth conduit L6 for allowing pure solvent to be collected in said fourth container B4 and a seventh conduit L7 for feeding pure solvent from the fourth container to the second container B2.

Other means are provided to see to that the volume V4 of pure solvent which through the seventh conduit L7 can flow from the fourth container B4 to the second container B2 is equal to or less than the volume V2 for pure solvent in the second container B2 either it is completely empty or contains a certain amount of pure solvent when you start to transfer pure solvent from the fourth container B4 to the second container B2.

Said other means can be located and designed in different ways such that the volume V4 of pure solvent accessible for transfer in the fourth container B4 is equal to or less than the volume V2 for pure solvent in the second container B2.

A fourth liquid pump P4 can be provided to pump pure solvent from the fourth container B4 to the second container B2. With this embodiment and if there is also a third liquid pump P3 for pumping impure solvent from the first container B1 to the third container B3, the wash cabinet 6 and the distilling device 8 can be located at a great distance from each other, e.g. in separate rooms. This might be advantageous for fire precaution and/or labour welfare reasons.

Figure 3:
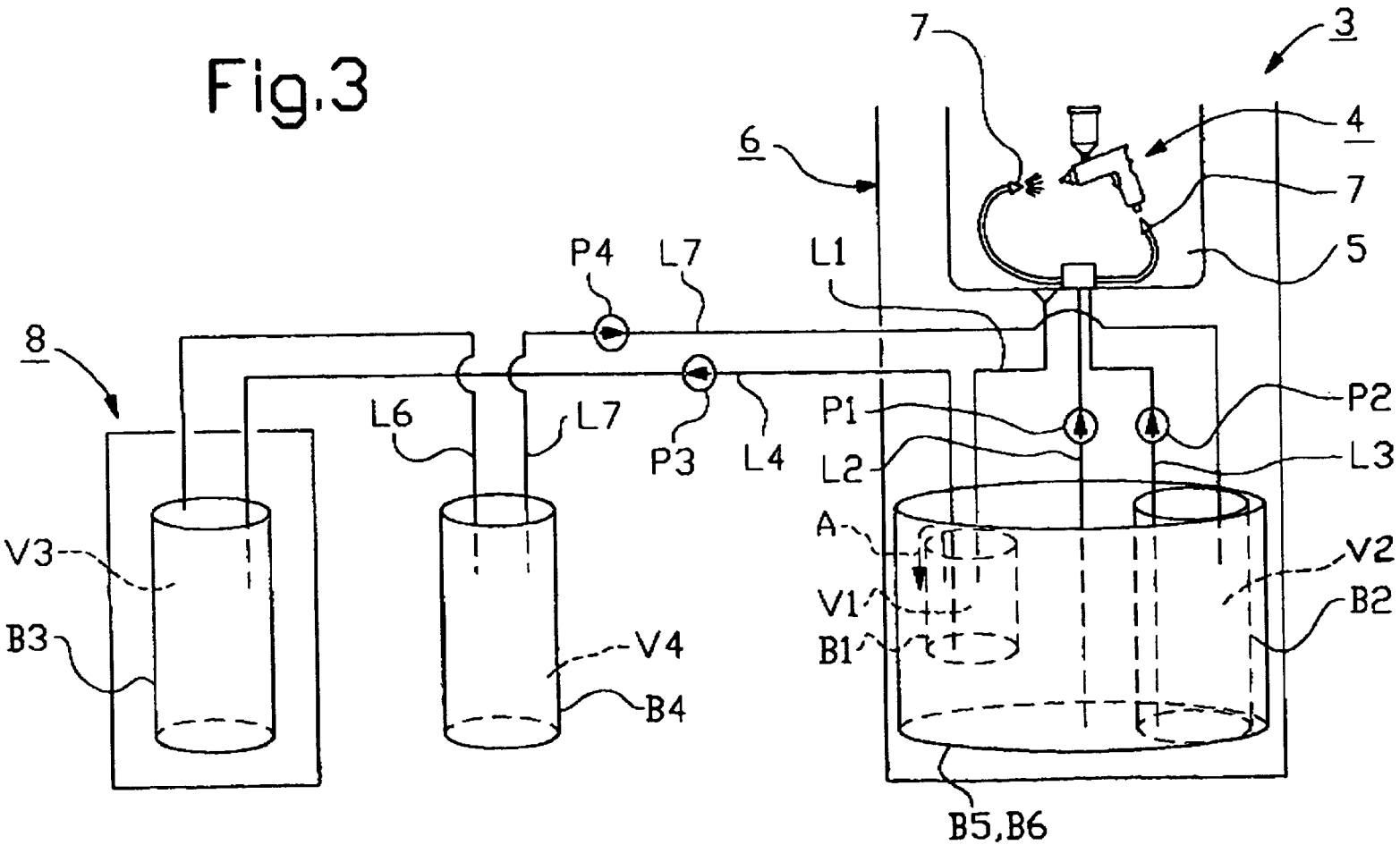
FIG. 3 illustrates a second alternative embodiment of the washing apparatus according to the invention.

The washing apparatus 3 of FIG. 3 corresponds with the washing apparatus of FIG. 2 except that the second container B2 is located in a fifth container B5 which together with the container B6 can be one and the same outer container. Pure solvent can flow over from the second container B2 to the outer container defined by the containers B5, B6 if the second container B2 already contains solvent and additional solvent is fed thereto and if the volume of additional solvent can not be accommodated therein.

By providing the second container B2 in an outer container B5, B6 and pure solvent is allowed to flow over from the second container B2 to the outer container B5, B6, it is not necessary to carry out manual controls in order to establish the volume of pure solvent in the second container B2.

Figure 4:
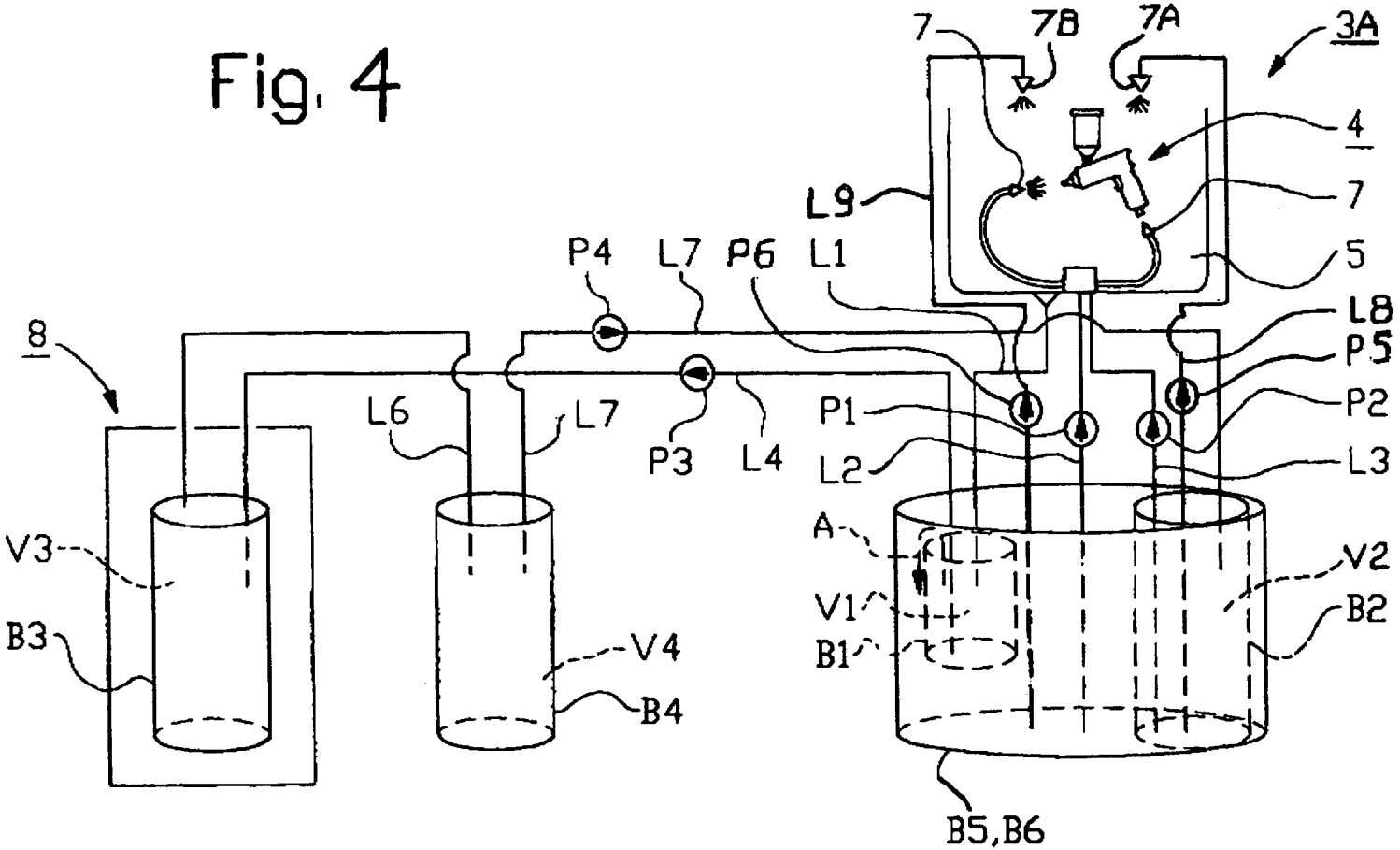
FIG. 4 illustrates a third alternative embodiment of the washing apparatus according to the invention.

In FIG. 4 there is illustrated a washing apparatus 3A which substantially corresponds with the washing apparatus 3 of FIG. 3 but which also has at least one washing-liquid nozzle 7A for carrying through a manual washing operation with pure solvent, i.e. the start and stop of the washing operation as well as the length thereof is controlled manually. An eighth conduit L8 is provided to feed pure solvent from the second container B2 to said washing-liquid nozzle 7A and a liquid pump P5 is provided to pump pure solvent from said second container B2 to said washing-liquid nozzle 7A. There may also be at least one washing-liquid nozzle 7*b* for carrying through a manual washing operation with impure solvent and a ninth conduit L9 can be provided to feed impure solvent from the container B5, B6 to said washing-liquid nozzle 7B. A liquid pump P6 can be provided for pumping the impure solvent from the container B5, B6 to said latter washing-liquid nozzle 7B.

The washing-liquid nozzles 7A and/or 7B can be located inside or outside the wash chamber 5 and solvent discharged or ejected therefrom is collected in the container B1.

As is further apparent from FIG. 4, the washing apparatus 3A may do without the wash cabinet 6.

The invention is not limited to the washing apparatus 1, 2 or 3 described above and illustrated in the drawings, but may vary within the scope of the subsequent claims. Said first and/or second means may consist of or include time-controlled pumps or similar and it should be mentioned that the washing liquid can be another suitable liquid than a solvent. It should further be mentioned that the container B2 may form an active part of the distilling device 8, namely such part where condensation of vaporized washing liquid takes place.

What is claimed is:

1. Device for washing an object with washing liquid, comprising:

a wash chamber (5) in which the object (4) is located for washing, a first container (B1) for collecting impure washing liquid, impure washing liquid flowing from the wash chamber (5) to the first container (B1) through a first conduit (L1), a second conduit (L2) is provided through which impure washing liquid can be brought to flow back to the wash chamber (5) for reuse, a second container (B2) for collecting pure washing liquid, pure washing liquid flowing from the second container (B2) to the wash chamber through a third conduit (L3) so that the object may be washed with pure washing liquid, a distilling device (8) for distillation of impure washing liquid and obtaining pure washing liquid, the distilling device (8) including a third container (B3) in which impure washing liquid is vaporized, impure washing liquid flowing from the first container (B1) to the third container (B3) through a fourth conduit (L4), pure washing liquid obtained by means of the distilling device (8) flowing from the third container (B3) to the second container (B2) through at least a fifth conduit (L5), the first container (B1) having a volume (V1) that is equal to or less than a volume (V3) for washing liquid in the third container (B3) for preventing the third container (B3) from becoming overfull, the first container (B1) cooperating with a sixth container (B6) such that impure washing liquid flowing from the wash chamber (5) to the first container (B1) can flow over from the first container (B1) into the sixth container (B6) when the volume of the first container (B1) is filled.

2. The device of claim 1 wherein the sixth container (B6) is an outer container in which the first container (B1) is provided such that impure washing liquid can flow over from the first container (B1) into the sixth container (B6).

3. The device of claim 1 wherein the second conduit (L2) is provided in the sixth container (B6), a first pump (P1) is provided for pumping impure washing liquid through the second conduit (L2) from the sixth container (B6) to washing-liquid nozzles (7) which are adapted to discharge washing liquid for washing the object.

4. The device of claim 1 further including a fourth container (B4) for collecting pure washing liquid, pure washing liquid obtained by means of the distilling device (8) flowing through a sixth conduit (L6) to the fourth container (B4), pure washing liquid flowing from the fourth container (B4) to the second container (B2) through the seventh conduit (L7), and means for limiting flow of pure washing liquid through the seventh conduit (L7) from the fourth container (B4) to the second container (B2) to an amount that is equal to or less than a volume for pure washing liquid in the second container (B2).

5. The device of claim 4 wherein a third pump (P3) is provided for pumping impure washing liquid through the fourth conduit (L4) from the first container (B1) to the third container (B3) and a fourth pump (P4) is provided for pumping pure washing liquid through the seventh conduit (L7) from the fourth container (B4) to the second container (B2).

6. The device of claim 1 wherein the second container (B2) cooperates with a fifth container (B5) such that pure washing liquid can flow over from the second container (B2) into the fifth container (B5) when the second container (B2)

is not completely empty and additional pure washing liquid is fed to the second container (B2).

7. The device of claim 6 wherein the fifth container (B5) is an outer container in which the second container (B2) is located.

8. The device of claim 1 wherein the second container (B2) cooperates with the fifth container (B5) such that pure washing liquid can flow over from the second container (B2) into the fifth container (B5) when the second container (B2) is filled and additional pure washing liquid is fed to the second container (B2) and wherein the fifth container (B5) is an outer container (B5, B6) in which the first and second containers (B1, B2) are located.

9. The device of claim 8 wherein a volume (V2) of the second container (B2) is less than the volume (V3) of the third container (B3) such that pure washing liquid fed to the second container (B2) from the third container (B3) flows over from the second container (B2) to the fifth container (B5), in which the first and second containers (B1, B2) are located, in order to mix impure and pure washing liquid in the fifth container (B5).

10. The device of claim 1 wherein a first pump (P1) is provided to pump impure washing liquid through the second conduit (L2) to at least one washing-liquid nozzle (7) which is adapted to discharge impure washing liquid for carrying through an automatic washing operation, and a sixth pump (P6) is provided to pump impure washing liquid to the at least one washing-liquid nozzle (7B) for discharge of impure washing liquid for carrying through a manual washing operation.

11. The device of claim 1 wherein a second pump (P2) is provided to pump pure washing liquid from the second container (B2) to at least one washing-liquid nozzle (7) which is adapted to discharge pure washing liquid for carrying through an automatic washing operation, and a fifth pump (P5) is provided to pump pure washing liquid from the second container (B2) to the at least one washing-liquid nozzle (7A) for discharge of pure washing liquid for carrying through a manual washing operation.

* * * * *